US006923115B1

(12) United States Patent
Litscher et al.

(10) Patent No.: US 6,923,115 B1
(45) Date of Patent: Aug. 2, 2005

(54) METHOD, APPARATUS AND SYSTEM FOR PRINTING ON TEXTURED, NONPLANAR OBJECTS

(75) Inventors: D. Michael Litscher, Shawnee, KS (US); Ross Clayton Litscher, 340 9th St. - apt. 3F, Brooklyn, NY (US) 11215

(73) Assignee: Ross Clayton Litscher, Shawnee, KS (US)

( * ) Notice: Subject to any disclaimer, the term of this patent is extended or adjusted under 35 U.S.C. 154(b) by 45 days.

(21) Appl. No.: 10/716,999

(22) Filed: Nov. 19, 2003

(51) Int. Cl.[7] ..... B41F 17/30; B41F 17/34

(52) U.S. Cl. ..... 101/35; 101/DIG. 40; 101/38.1; 347/2

(58) Field of Search ..... 101/35, 41, 38.1, 101/39, 40, 40.1, DIG. 40; 347/2, 4

(56) References Cited

U.S. PATENT DOCUMENTS

| | | | | |
|---|---|---|---|---|
| 1,339,569 | A | 5/1920 | Lyon | |
| 1,527,691 | A | 2/1925 | McNab et al. | |
| 1,921,571 | A | 8/1933 | Jones | 197/6.2 |
| 1,999,647 | A | 4/1935 | Atti | 197/47 |
| 5,123,345 | A | 6/1992 | Wood | 101/124 |
| 5,632,205 | A * | 5/1997 | Gordon et al. | 101/483 |
| 5,832,819 | A | 11/1998 | Widman | 101/34 |
| 6,245,386 | B1 | 6/2001 | Felker et al. | 427/258 |
| 6,295,737 | B2 | 10/2001 | Patton et al. | 33/18.1 |
| 6,418,843 | B1 | 7/2002 | Givler | 101/35 |
| 6,462,812 | B1 * | 10/2002 | Heene et al. | 356/237.1 |
| 6,538,767 | B1 * | 3/2003 | Over et al. | 358/1.18 |
| 2002/0097280 | A1 * | 7/2002 | Loper et al. | 347/2 |
| 2002/0134257 | A1 * | 9/2002 | Stephenson | 101/35 |

FOREIGN PATENT DOCUMENTS

| | | |
|---|---|---|
| JP | 11-320863 | * 11/1999 |
| JP | 2002-337329 | * 11/2002 |

* cited by examiner

*Primary Examiner*—Leslie J. Evanisko
(74) *Attorney, Agent, or Firm*—Brian S. Steinberger; Law Offices of Brian S. Steinberger, P.A.

(57) ABSTRACT

A printing system, method, and apparatus apply indicia to a textured nonplanar object surface, such as a golf balls, baseballs, tennis ball, other types of sports balls, and other spherical, semi-spherical, cylindrical or other objects having textured, irregular curved, non-planar, or non-linear surfaces using fast drying permanent ink, ink jet printing technology through the use of an indicia-generating unit at a single station. The object is mounted on an elevatable turntable and positioned within a gimbal assembly. The object is clamped in the gimbal assembly that rotates and pivots the object as the image is transferred to the object. The system may be used to print indicia, on-demand, on individual objects or on a plurality of objects, and can be connected to a PC, and/or as part of a vending machine that accepts cash and/or credit cards, and the like.

21 Claims, 19 Drawing Sheets

PRINTING TEMPLATES

TEMPLATE FOR 1 POLE

TEMPLATE FOR 2 POLES

TEMPLATE FOR IMAGE BAND

METHOD, APPARATUS AND SYSTEM FOR PRINTING ON TEXTURED, NONPLANAR OBJECTS

This invention relates generally to permanent printing on textured, nonplanar objects, and, more particularly, to methods, apparatus, and systems for applying indicia to golf balls, baseballs, tennis ball, and other spherical, semi-spherical, cylindrical or other objects having textured, irregular curved, non-planar, or non-linear surfaces using fast drying permanent ink, ink jet printing technology at a single station.

BACKGROUND AND PRIOR ART

Golf aficionados have long desired to identify and personalize golf balls for various reasons. Identification of the ball is required in official play. Most golfers mark balls to ensure that they have found and played the correct one. Balls can be marked with an alignment line around the circumference of the ball to orient the ball and as a reference mark and aid. And, as printing techniques and digital camera technology have advanced, golfers have desired digital photos, graphics or some type of decorative logo to be printed on the outer surface of the ball designed, for example, to advertise or identify a particular corporate entity, golf course, club, or resort, or as a remembrance or memento or souvenir of a place, an event or a special person.

Existing techniques for printing on a curved, non-planar surface such as a golf ball are limited, not timely and are not economically feasible when the quantity to be printed is less than a few dozen. One technique has been to apply a decal to the surface of the ball and then to spray the ball with a clear overcoat surface. The use of decals, though, can be troublesome and applying anything that affects the flight of a golf ball is not allowed by the Professional Golf Association. Decals are typically produced using a silk-screen process and are expensive for small quantity orders. The application of the decals and then subsequent clear overcoat is labor-intensive and thereby costly.

Another technique for printing text and graphics on curved objects is pad printing as disclosed in U.S. Pat. No. 5,537,921 to Adner et al., U.S. Pat. No. 5,806,419 to Adner et al., and U.S. Pat. No. 5,778,793 to Mello et al. The pad printing technique involves the use of a printing plate engraved or photo-etched with an image pattern. Ink applied to the printing plate is then transferred to a flexible pad placed in contact with the printing plate. The pad is then removed from the printing plate and then placed in contact with the surface to be printed, such as the surface of a golf ball.

Pad printing has many shortcomings for printing an image on a small quantity of objects. The fabrication of a printing plate requires that an image be developed and transferred, either by engraving or by a photographic process, to the plate. The plate itself can be expensive and transferring an image to the plate is time consuming. For every new image to be printed on an object, a new plate must be fabricated and mounted into the pad printing system. The lead-time required to proof the artwork by the customer and produce the printing pad is generally weeks and not available to individuals at home or in a retail setting.

U.S. Pat. No. 5,831,641 to Carlson describes another system for printing text and graphics on an object. This system discloses the use of an ink jet plotter and a mechanism to hold, position, and rotate the object. Ink jet plotting basically involves a process whereby ink particles are projected in a continuous stream toward the surface to be imprinted using appropriate computer control to create text and graphics on the printing surface. The ink jet plotter moves along a linear axis with the object positioned so that the surface of the object presents a planar surface to the ink jet plotter. This method of applying images is limited to objects with a surface that can be positioned so that the surface is parallel to the travel axis of the ink jet plotter. Although this system can be advantageous for applying an image to a small number of objects, many curved objects, such as balls and ornaments, do not present planar surfaces upon which an image can be applied.

U.S. Pat. No. 6,538,767 to Over et al. describes a system for printing on spherical and semi-spherical objects using a plurality of print heads, a graphics unit containing one or more ink jet printers and one or more drying stations. This system, as explained in the patent, overcomes the disadvantages of the contact printing techniques described above and the limitations of the Carlson patent. This system involves the use of a fixture to position and rotate an object and a control unit for moving the graphics unit so that the graphics unit is maintained at a desired position relative to the object as the graphics unit applies the image to the object. The graphics unit is also movable in an arc relative to the object so that an image can be applied around the perimeter of the object as it is rotated in the fixture. The image to be applied is separated into tracks and the graphics unit successively applies the image tracks to individual tracks on the object as it is rotated.

The system described in the Over patent has several limitations. The graphics unit moves in an arc relative to the object as the object is rotated along its axis a designated distance from the graphics unit. Each station and associated graphics unit applies a single color. After the application of an individual color at its dedicated station the object must be dried by ultraviolet light at a dedicated drying station. An image that consists of multiple colors requires that an object be moved from graphics unit to graphics unit and results in a complex and expensive system. Rotating the object, moving the graphics unit in an arc relative to the object, and then moving the object from graphics unit to graphics unit necessitates a complex control unit. The image preparation for printing requires a spherical transformation and the associated data tracks which necessitate a trained operator. This process still requires time to interact with the customer to approve the graphics before they can be applied.

Another U.S. Pat. No. 5,832,819 to Widman describes a "method for transferring an image onto an object having curved surfaces", title, that requires the target surface be substantially flattened by pressing or separating a surface layer, followed by heat being applied to the surface. Furthermore, the object must be later cooled in water and then alcohol. The flattening and heating process required by this process can potentially harm and even destroy some objects such as golf balls. Also, the mechanical steps, and later steps of immersion in water and alcohol require further undesirable and time consuming steps that would not be practical to users of the process.

Thus, the need exists for solutions to the above problems.

SUMMARY OF THE INVENTION

The first objective of the present invention is to provide a system, method, and apparatus for applying images to spherical or semi-spherical objects using a permanent quick drying, ink such as a multi-color inkjet cartridge.

The second objective of the present invention is to provide a system, method, and apparatus for creating, receiving, manipulating, and applying an image, multiple images or combined images including text, clip art, photographs, photocopies, or a custom image.

The third objective of the present invention is to provide a system, method, and apparatus for applying images at a single polar location, at dual polar locations, or along a band around the circumference of the spherical or semi-spherical objects with irregular and textured surfaces avoiding any existing logos.

The fourth objective of the present invention is to provide a system, method, and apparatus for transferring digital images and applying images that can be operated by an individual with limited computer experience in retail or home setting to custom print a limited number of objects.

The fifth objective of this invention is to provide a system, method, and apparatus for applying images wherein the systems is a free standing vending machine wherein payment is made by way of a bill acceptor or credit card reader.

The seventh objective of this invention is to provide a system, method, and apparatus for applying images to objects with curved surfaces at a single station without having to flatten portions of the object, take apart portions of the object, or heat, or cool the object.

The present invention addresses the problems described above by providing methods and systems for printing permanent text and indicia such as but not limited to graphics, and the like, on small quantities of objects having curved, non-planar, or non-linear textured and irregular surfaces. These objects include, but are not limited to, spherical objects such as golf balls, baseballs, or basketballs, and other objects such as plastic eggs.

Several embodiments of the invention are included. All embodiments include a golf ball printer having a fixture for receiving and holding the ball, a graphics unit for receiving graphics data and applying the graphics to the golf ball, and a gimbal assembly for moving the golf ball relative to the graphics unit. The preferred embodiment of the invention includes the golf ball printer in a facility as may typically be found in a commercial establishment. The facility provides a means for the customer to designate text, clip art, or a custom digital image, as supplied by the customer, for printing on the golf ball. The facility has the capacity to print from one to twelve golf balls at a time with payment made by way of a bill acceptor or credit card reader. The second embodiment of the invention includes the golf ball printer connected to a personal computer in a commercial establishment. A third embodiment of the invention includes the golf ball printer connected to a personal computer in a home setting.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Figure 1:
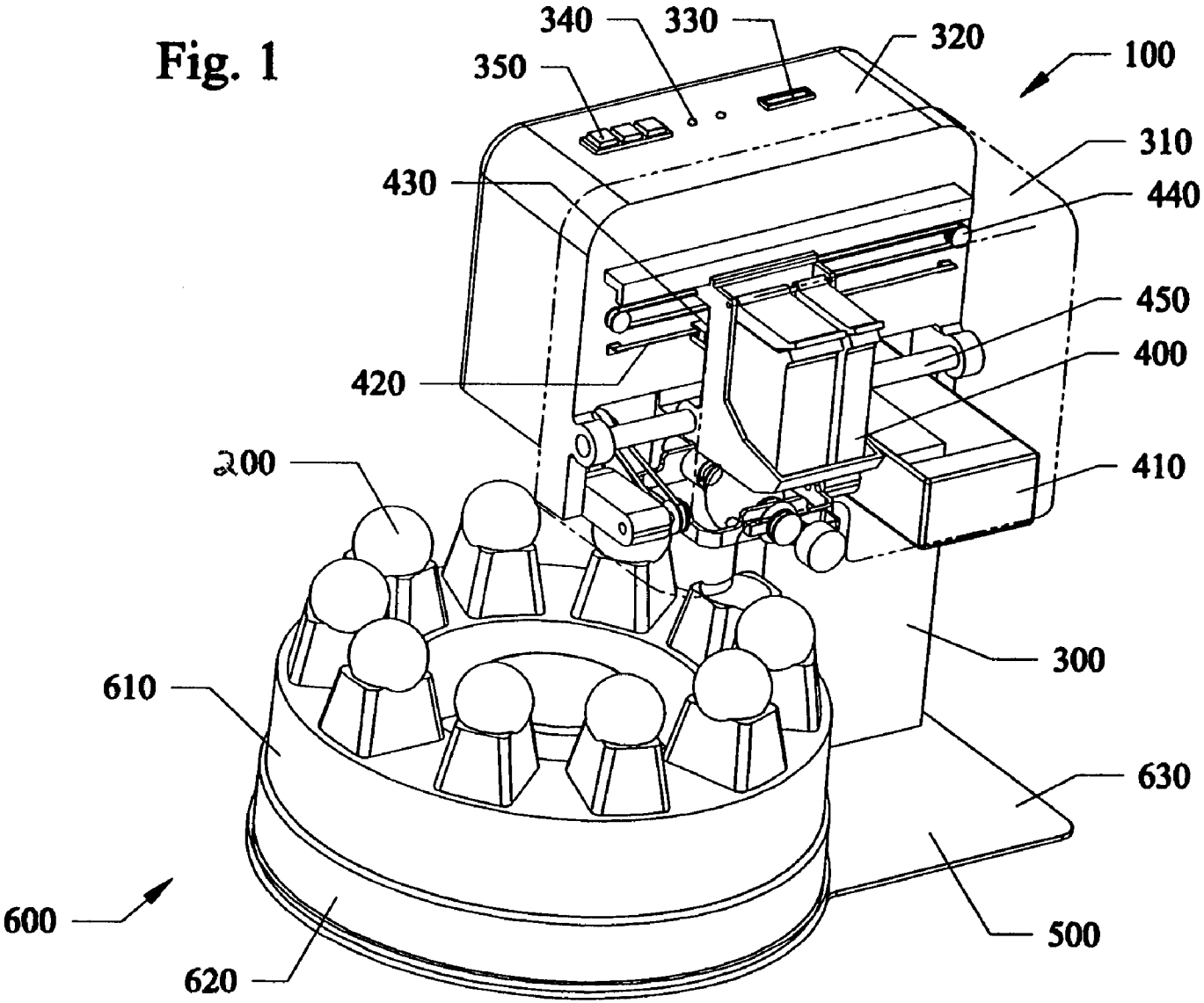
FIG. 1 is a front perspective view of the preferred embodiment of the novel Golf Ball Printer with the ball feeder carousel/carriage shown in the lowered position.
Figure 2:
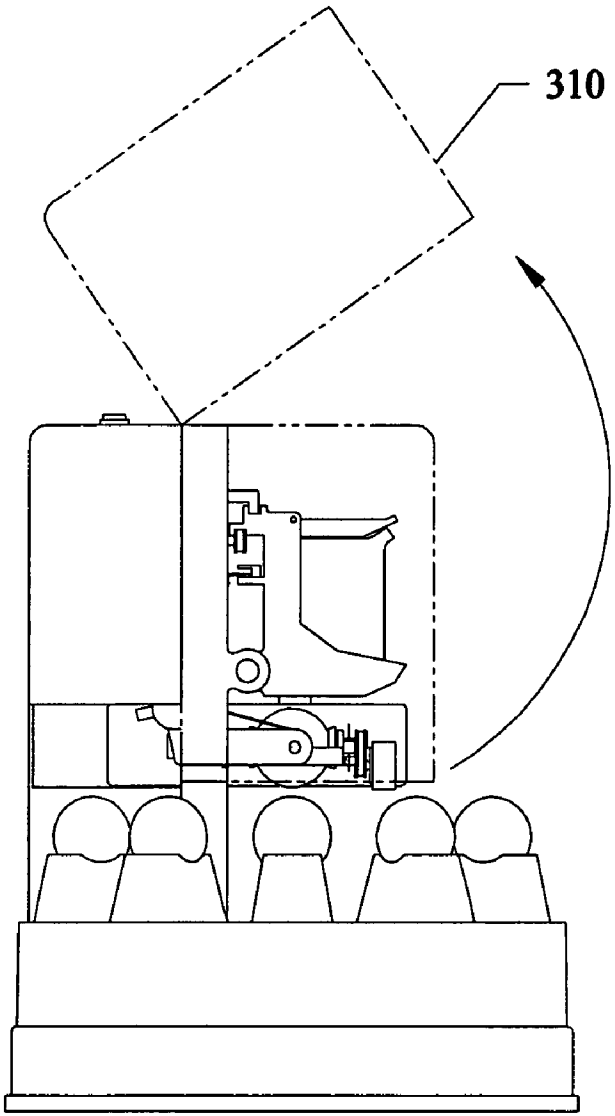
FIG. 2 is a side view of the subject invention of FIG. 1 showing the hinged front cover, in outline form, in both the raised and the lowered positions.
Figure 3:
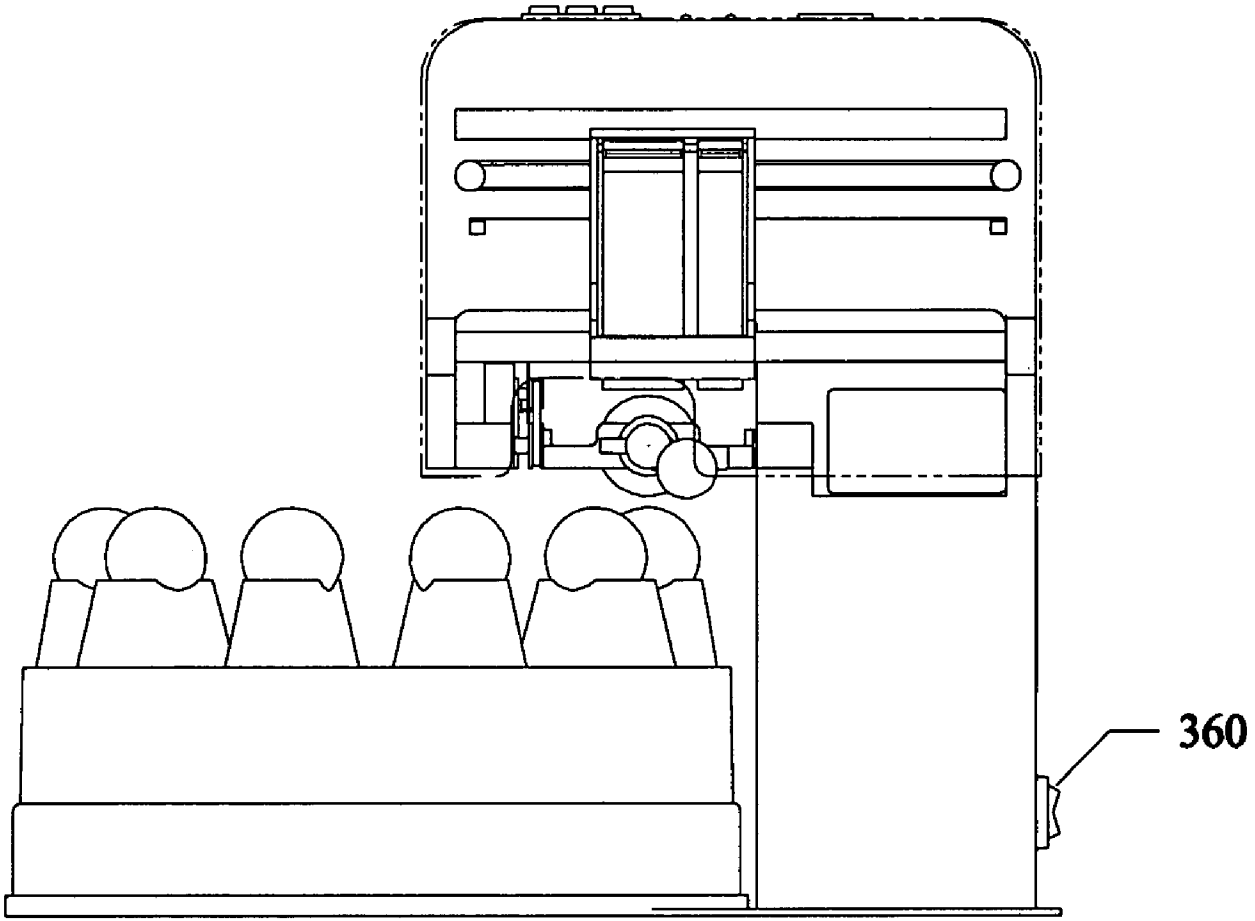
FIG. 3 is a front view of the subject invention of FIG. 1.
Figure 4:
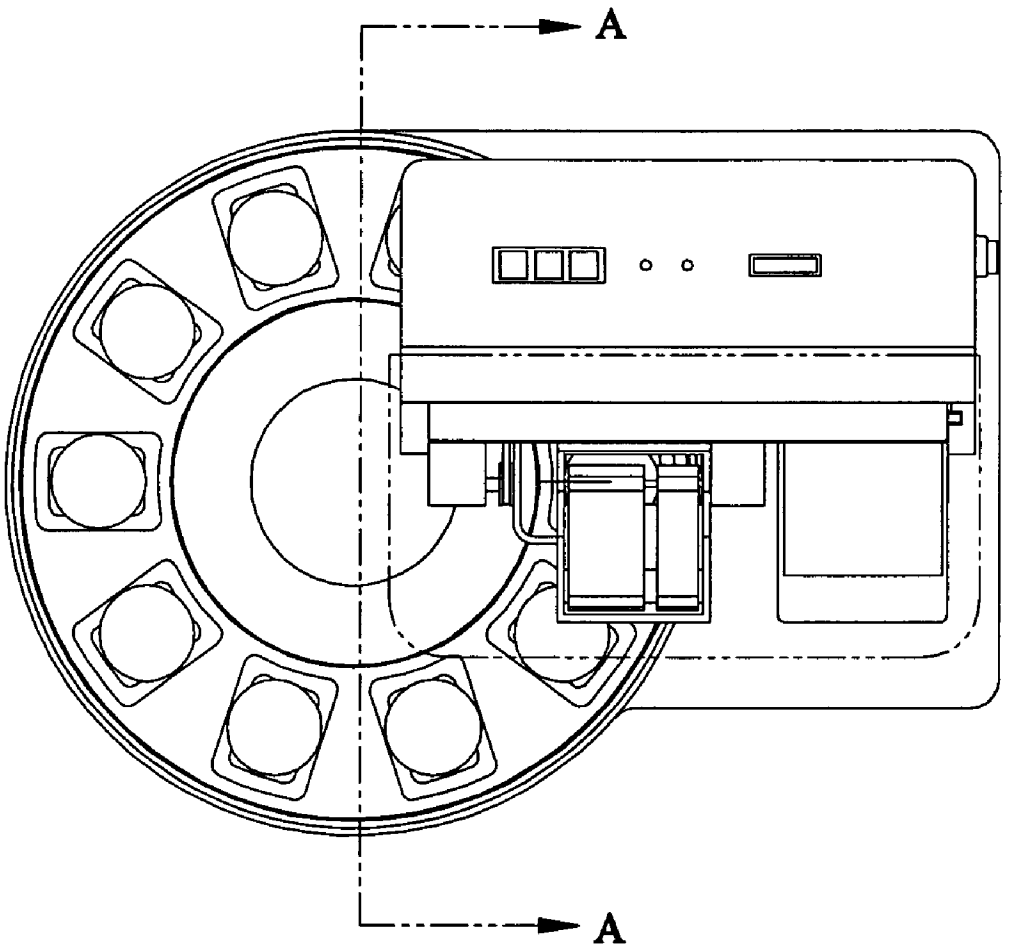
FIG. 4 is a top view of the subject invention of FIG. 1.
Figure 5:
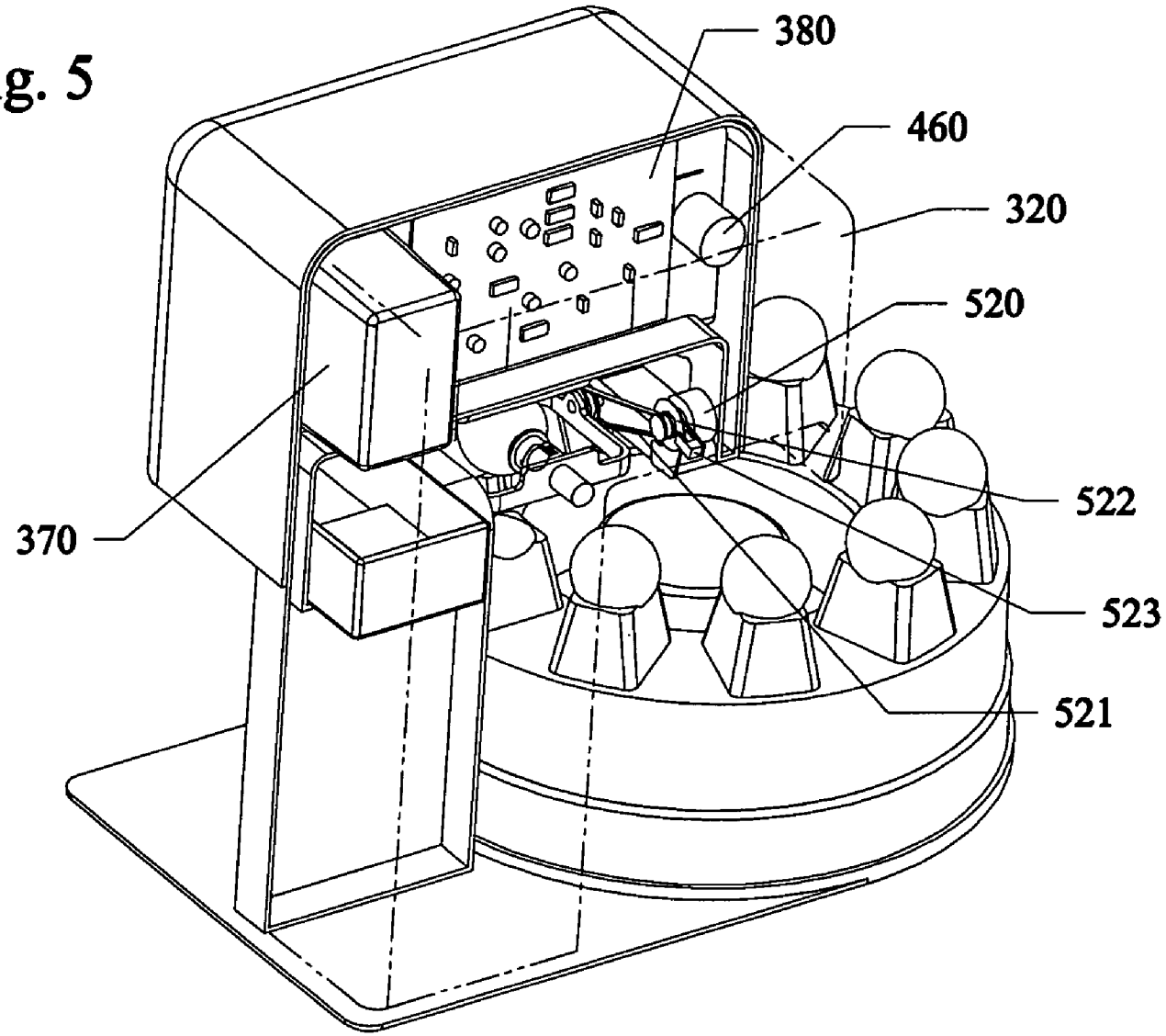
FIG. 5 is a rear perspective view of the subject invention with the electronics cover shown in outline form.

FIG. 1 shows a front perspective view of the preferred embodiment of the novel golf ball printer 100. FIG. 2 is a side view of the golf ball printer 100 of FIG. 1 showing the clear hinged front cover 310, in outline form, in both the lowered and the raised positions. FIG. 3 shows a front view of the golf ball printer 100 of FIG. 1. FIG. 4 shows a top view of the golf ball printer 100 of FIG. 1. FIG. 5 shows a rear perspective view of the golf ball printer 100 of FIG. 1.

Referring to FIGS. 1 and 5, the golf ball printer 100 is comprised of a printer frame 300, a printing system including print head 400, a gimbal assembly 500, and a ball feeder assembly 600. The golf ball printer 100 can be used to print text and indicia on various types of objects, including, but not limited to, spherical objects, semi-spherical objects, objects having curved surfaces, objects having non-linear surfaces, textured surfaces, irregular surfaces or objects having non-planar surfaces. Some examples of such objects include ornaments, golf balls, eggs, tennis balls, baseballs, and cylinders. Furthermore, the invention advantageously allows text and indicia to be applied to one object or upwards to 12 objects, objects with preprinted logos, and to objects with difficult, irregular or textured surfaces. The elements of the golf ball printer 100 will be described in more detail below.

Printer Frame

The printer frame 300 provides a supporting structure for the golf ball printer 100 and includes a clear hinged front cover 310, as shown in FIG. 1 that allows the operator to view the printing of text and indicia onto the object and may be opened for access to the print head 400 as shown in FIG. 2. FIG. 1 shows the counter 330, indicator lights 340, and control buttons 350 that are mounted in the top of the printer frame 300. FIG. 3 shows the power switch 360 mounted to the side of the printer frame 300. FIG. 5 shows the controller printed circuit board 380 and the power supply 370 mounted in the rear of the printer frame 300 and covered by the electronics cover 320. Controller printed circuit board 380 receives the graphic input to be printed on the object from a computer and controls the functions of the ball feeder assembly 600 as necessary to rotate the carousel, transport the object to and from the gimbal assembly and print heads, rotate the gimbal assembly and the object relative to the print head, perform printing on the object, and return the object to the ball feeder assembly 600.

Printing System

FIG. 1 shows the printing system of the golf ball printer 100 and includes the print head 400 mounted to guide bar 450. The print head 400 is positioned longitudinally along the guide bar 450 by way of print head drive motor 460 coupled to the print head drive 440. The print head 400 position is determined by the encoder strip 420 and the sensor 430. The print head 400 includes a single black inkjet cartridge or a combination of a single black and a multicolor inkjet cartridge with quick drying permanent ink dispensed from the inkjet cartridge. The ink is a custom blend that is fast drying, permanent, and chemically compatible with thermoplastic resins used for golf ball covers such as Dupont Surlyn 8320. The print head 400 is positioned over the print head docking station 410 for storage until the printer is turned on. The print head 400 is then positioned over the object and ready to print. Upon completion of printing and the printer turned off, the print head 400 is repositioned into the print head docking station 410.

Gimbal Assembly

Figure 7B:
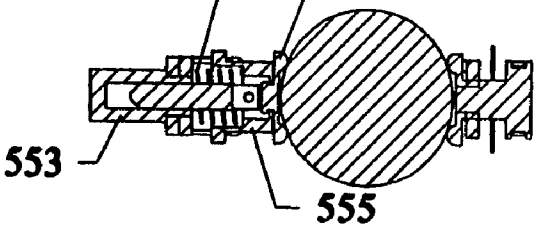
FIG. 7*b* is a cross sectional view of the gimbal assembly taken along line B—B of FIG. 7*a*.
Figure 7A:
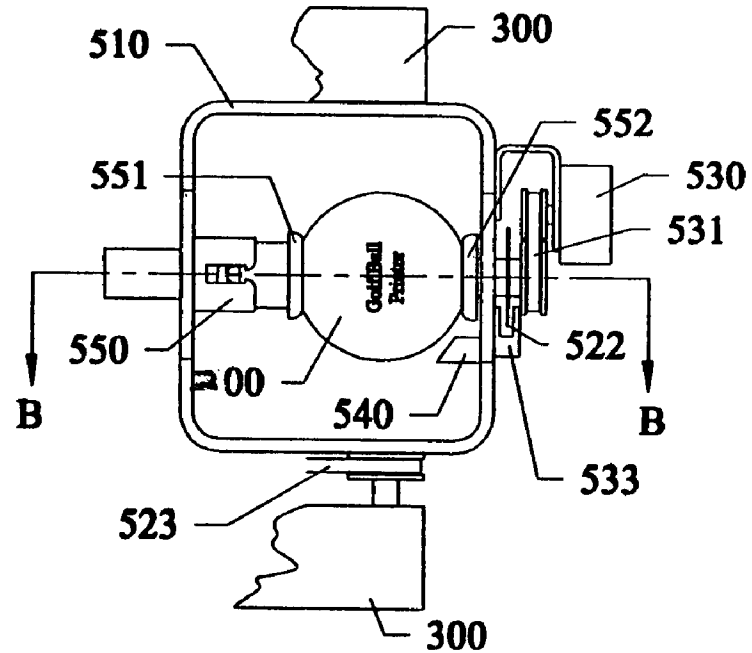
FIG. 7*a* is a top view of the gimbal assembly of the subject invention showing the ball in the clamped position.

FIG. 7*a* shows a detail view of the gimbal assembly 500 of golf ball printer 100 with the golf ball 200 in the capture position. FIG. 7*b* is a cross sectional view of the gimbal assembly 500 of FIG. 7*a* along line B—B. FIG. 8*a* shows a detail view of the gimbal assembly 500 of golf ball printer 100 with the golf ball 200 in the release position.

Figure 8B:
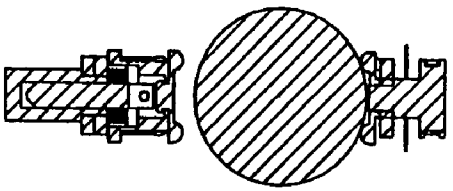
FIG. 8*b* is a cross sectional view of the gimbal assembly taken along line C—C of FIG. 8*a*.
Figure 8A:
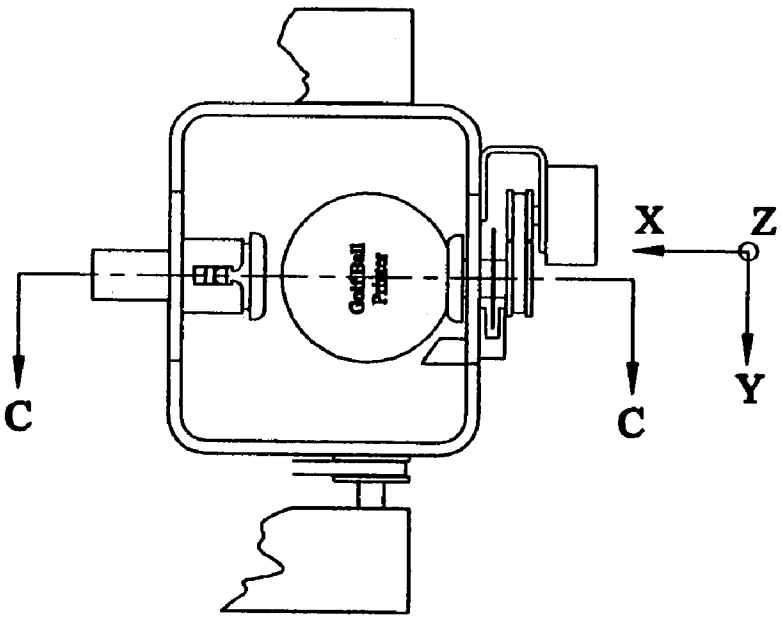
FIG. 8*a* is a top view of the gimbal assembly of the subject invention showing the ball in the released position.

FIG. 8*b* is a cross sectional view of the gimbal assembly 500 of FIG. 8*a* along line C—C.

Referring to FIGS. 7*a*, through 8*b*, golf ball 200 is secured and positioned for printing in gimbal assembly 500. Prior to capture in the gimbal assembly 500, ball out sensor 540 detects if there is a golf ball 200 on raised ball feeder carousel 610.

Golf ball 200 is captured within the gimbal frame 510 between freewheeling ball grip 551 and driving ball grip 552. Freewheeling ball grip 551, mounted on sliding grip mount 555 within grip housing 550, retracts linearly in from grip housing 550 when grip solenoid 553 is actuated, and extends by way of solenoid spring 554 to capture the object. After capture within the gimbal frame 510, golf ball 200 is rotated about the axis (Y-axis) that passes through the center of the freewheeling grip 551, the golf ball 200, and the driving ball grip 552. The Y-axis drive motor 530, through Y-axis drive belt 531, drives the driving ball grip 552 and rotates golf ball 200 about the Y-axis. The rotational position of the golf ball 200 is detected by the Y-axis encoder wheel 532 and Y-axis sensor 533. The Y-axis sensor 533 provides the feed back and controls the positioning of the object for printing about the Y-axis. The Y-axis drive motor 530 rotates golf ball 200, about the Y-axis, as required, through the entire 360-degrees of rotation. After the ball has been rotated one time and a line of printing has been completed the gimbal frame 510 and consequently the object 200 is indexed forward and the printing of the next line of data can be accomplished.

Figure 10:
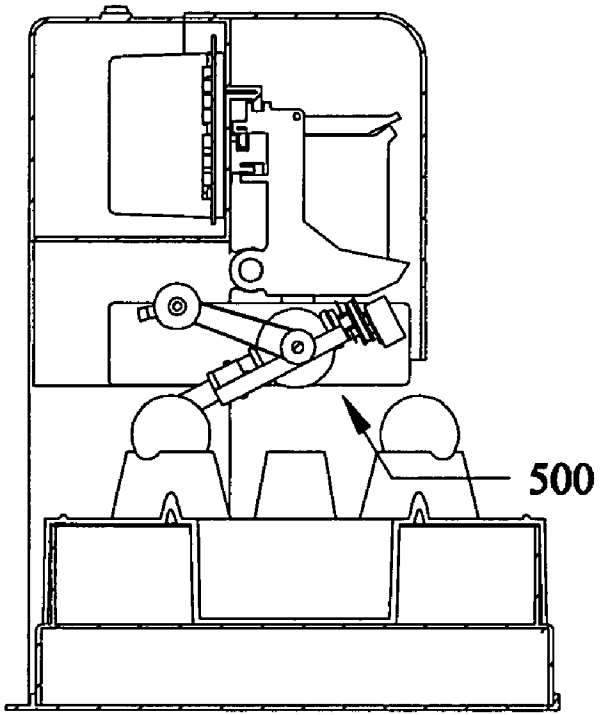
FIG. 10 is a cross sectional view of the subject invention taken along line D—D of FIG. 9.
Figure 9:
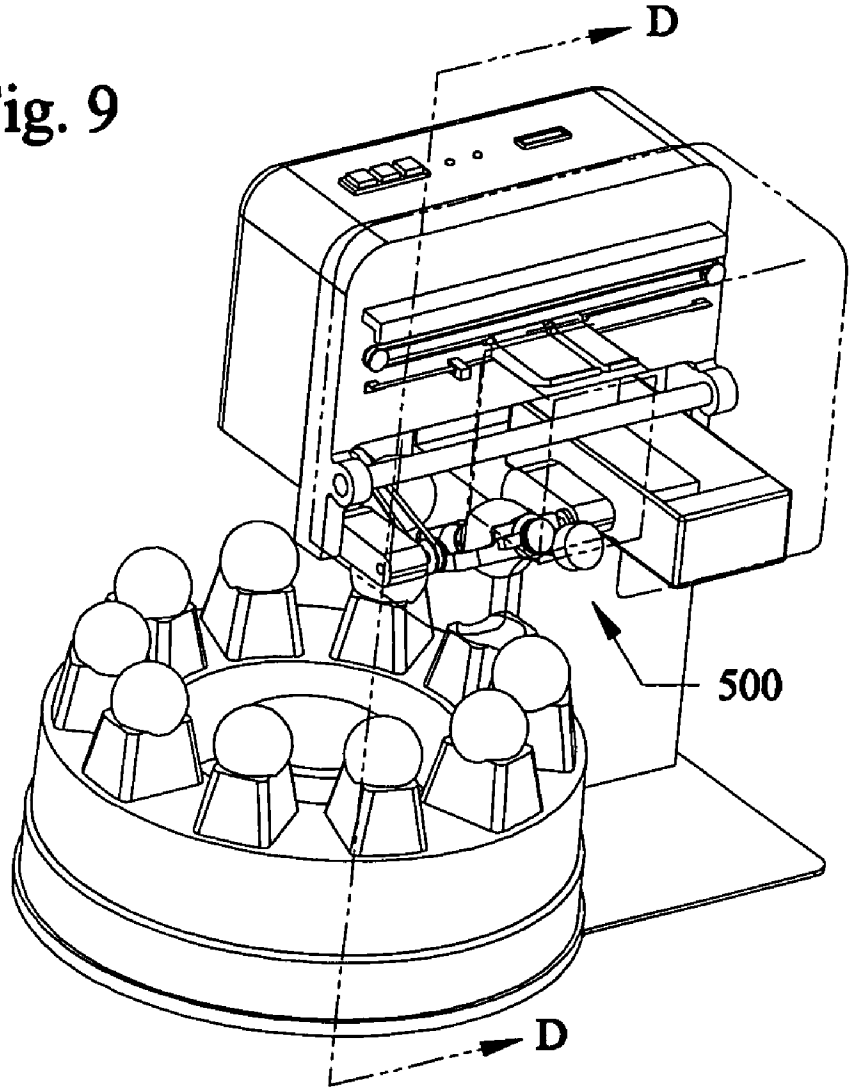
FIG. 9 is a front perspective view of the subject invention showing the gimbal assembly rotated to the rearward position.
Figure 12:
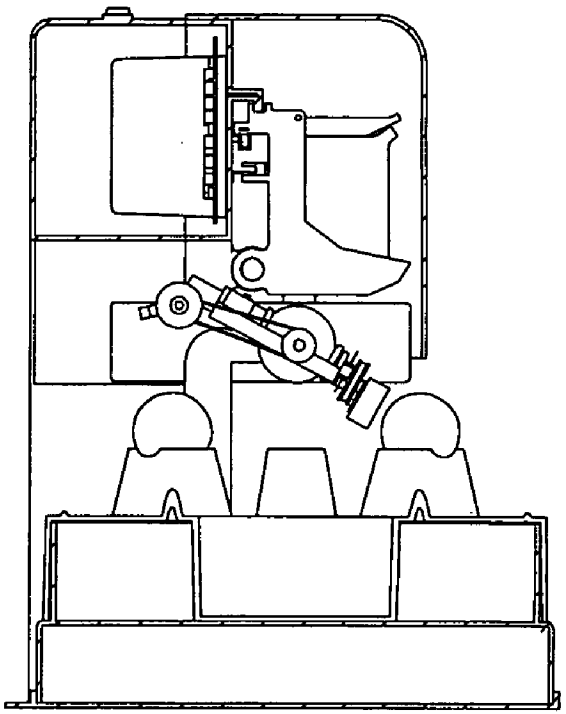
FIG. 12 is a cross sectional view of the subject invention taken along line E—E of FIG. 11.

Gimbal frame 510 is mounted in printer frame 300 and rotationally positioned along an axis (X-axis) that is perpendicular to the Y-axis rotation of the golf ball 200. Referring to FIGS. 5, 7*a*, and 8*a*, the X-axis gimbal drive motor 520, through the X-axis drive belt 521, rotationally positions the gimbal frame 510. At the beginning of the printing process the gimbal frame 510 is rotated about the x-axis to the full rearward position as shown in FIGS. 9 and 10 as determined by the x-axis sensor 523. When the printing of the first line has been completed, then gimbal frame 510 is indexed forward to the next position. Referring to FIG. 5 the x-axis motor 520 indexes the gimbal frame 510 and consequently the golf ball 200 to the next position for printing about the x-axis. The rotational position of the gimbal frame 510 is detected by the X-axis encoder wheel 522 and X-axis sensor 523. When the line of printing is sensed to be complete by the y-axis sensor 533 the golf ball 200 is index back to the beginning position by the y axis motor 530 about the y-axis as determined by the y-axis sensor 533. The gimbal frame 510 is then indexed forward to the next position as determined by the x-axis encoder wheel 522 and the x axis sensor 523. This process continues until the printing of the object 200 is completed.

FIG. 9 is a front perspective view of golf ball printer 100 showing golf ball 200 captured in the gimbal assembly 500 with ball feeder carousel 610 in the lowered position and gimbal assembly 500 rotated to the rear position. FIG. 10 is a side view of the golf ball printer 100 of FIG. 9 along section lines D—D.

Figure 11:
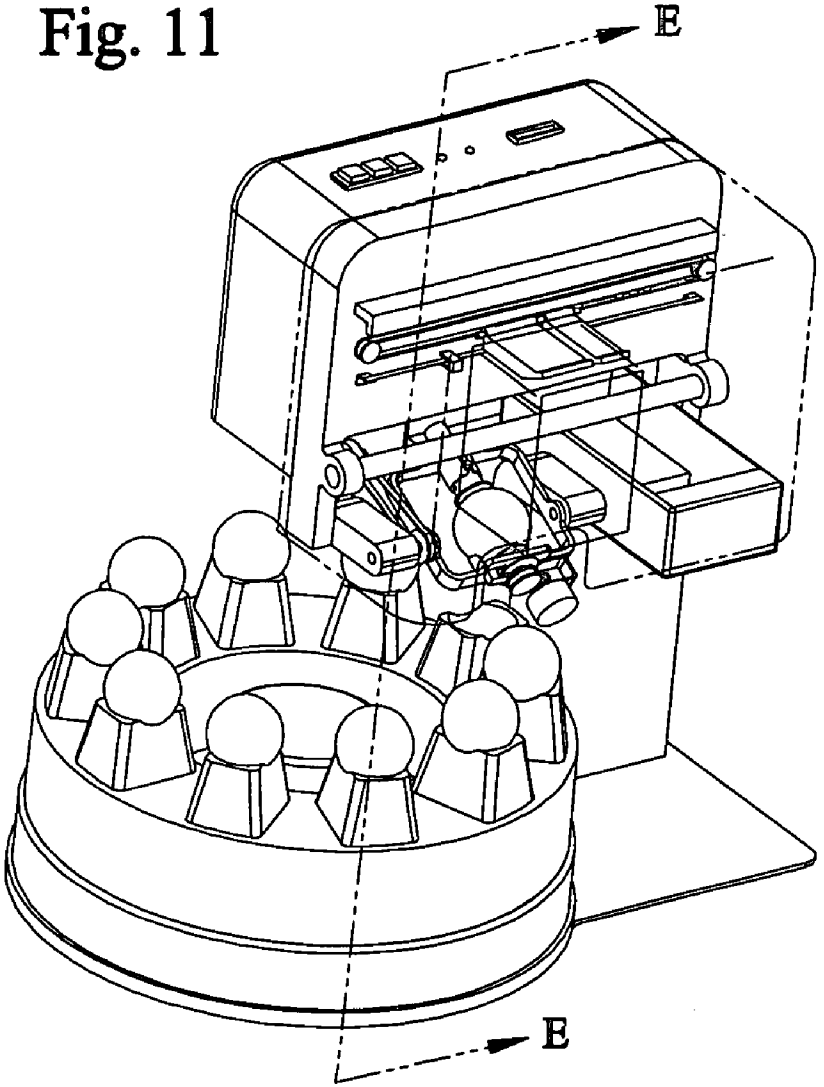
FIG. 11 is a front perspective view of the subject invention showing the gimbal assembly rotated to the forward position.

FIG. 10 is a front perspective view of golf ball printer 100 showing golf ball 200 captured in the gimbal assembly 500 with ball feeder carousel 610 in the lowered position and gimbal assembly 500 rotated to the forward position. FIG. 11 is a side view of the golf ball printer 100 of FIG. 10 along section lines E—E.

Once the object to be printed is clamped in the gimbal assembly 500, the ball feeder carousel 610 is lowered out of the way and printing is allowed to start. The printing and drying is accomplished at a single station. The print head is fixed in one position for printing while the object is rotated, in the gimbal assembly 500, about the X-axis and Y-axis beneath the print head.

Ball Feeder Assembly

Figures 13A, 13B, 13C:
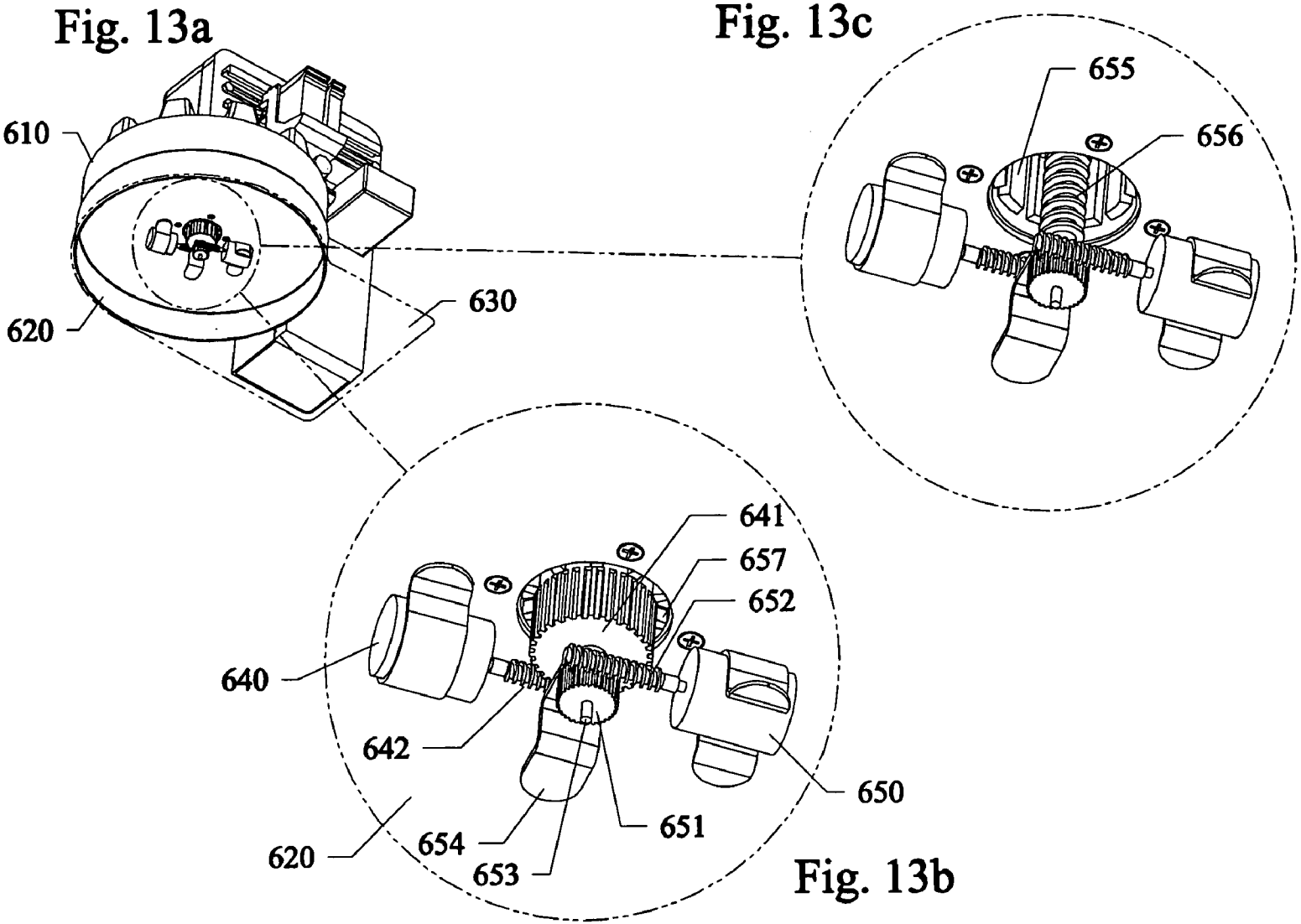
FIG. 13*a* is a perspective view of the ball feeder carriage assembly.
FIG. 13*b* is an enlarged detail of the ball feeder assembly of FIG. 13*a* showing the assembly in the lowered position.
FIG. 13*c* is an enlarged detail of the ball feeder assembly of FIG. 13*a* showing the assembly in the raised position.

FIG. 13*a* is a perspective view, as seen from the bottom of golf ball printer 100; of ball feeder assembly 600 comprised of the ball feeder carousel 610 (drawing shows "carriage" not carousel) and the ball feeder drive 620. The ball feeder base 630 is shown in outline form to abut against bracket 654(shown in FIG. 13*b*) to reveal the details of the ball feeder drive 620. FIG. 13*b* is an enlarged view of the ball feeder drive 620 of FIG. 13*a* with the ball feeder carousel 610 in the lowered position. FIG. 13*c* is an enlarged view of the ball feeder drive 620 of FIG. 13*a* with the ball feeder carousel 610 in the raised position.

Figure 14:
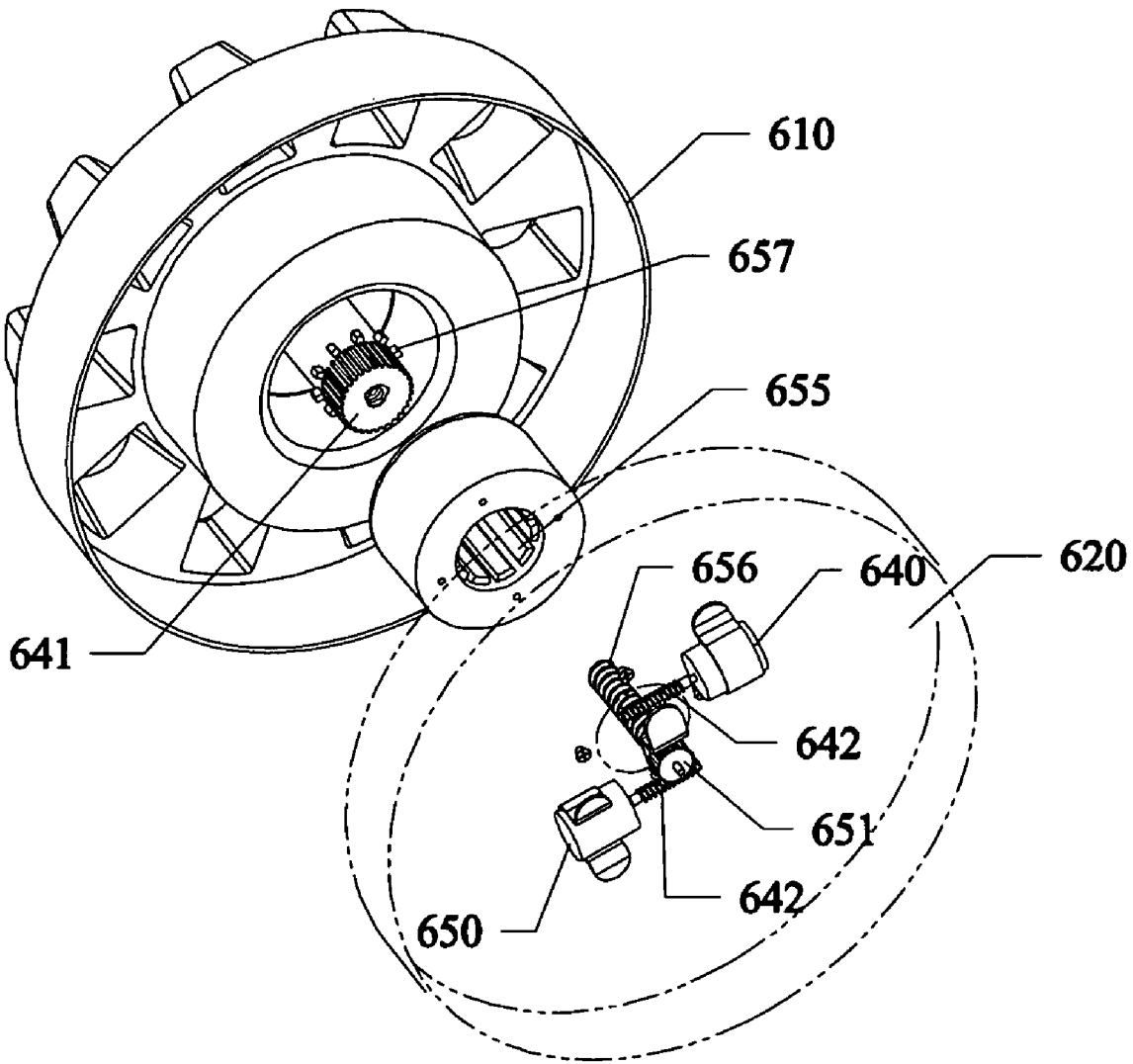
FIG. 14 is an exploded view of the ball feeder assembly components.
Figures 15A, 15B:
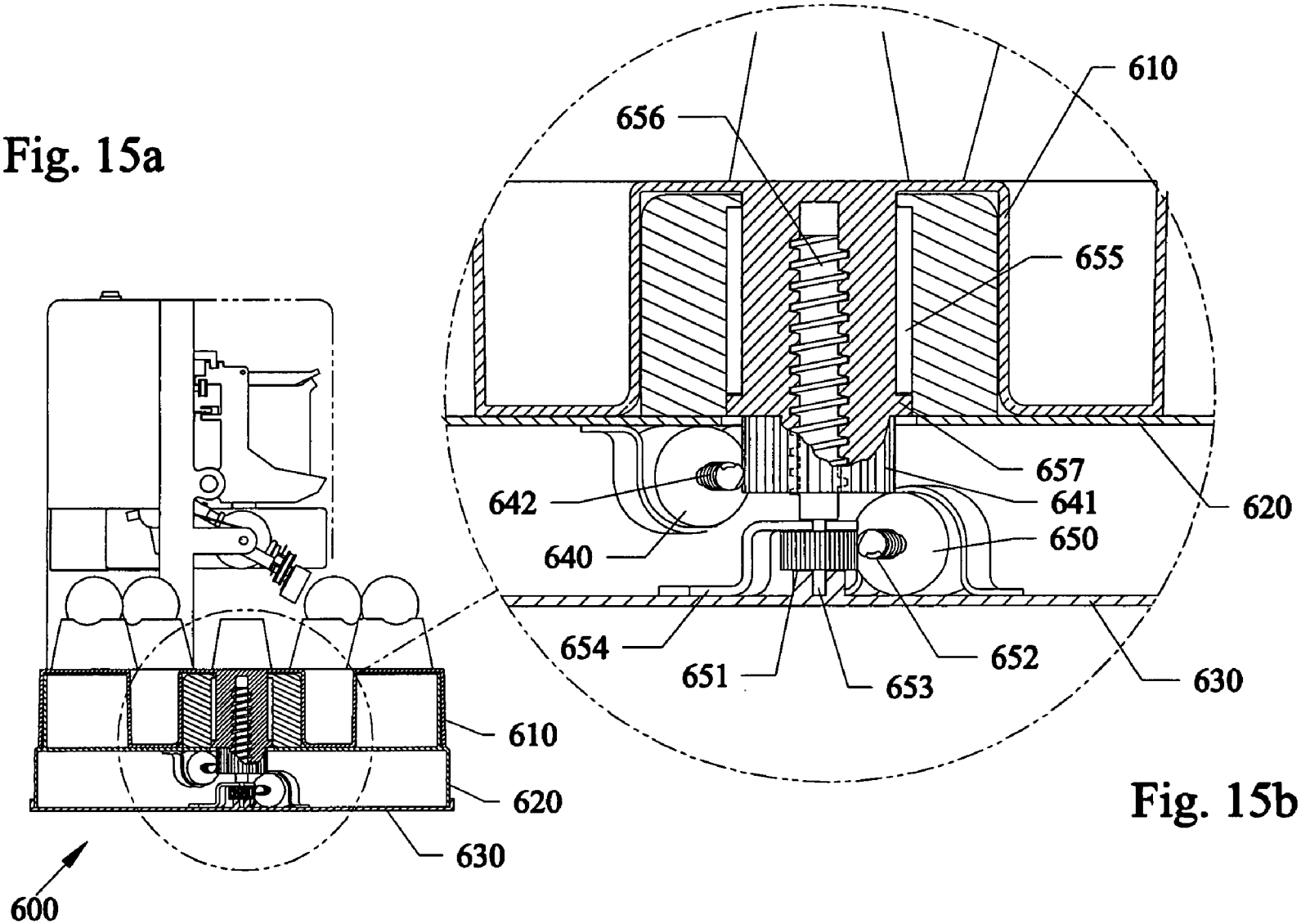
FIG. 15*a* is a section view of the subject invention, taken along line A—A of FIG. 4, with the ball feeder carousel shown in the lowered position.
FIG. 15*b* is a detail of the ball feeder assembly from FIG. 15*a*.

FIG. 14 is an exploded view of ball feeder assembly 600. FIG. 15*a* is a cross sectional view of golf ball printer 100, along line A—A of FIG. 4, with ball feeder assembly 600 in the lowered position. FIG. 15*b* is an enlarged section detail of the ball feeder assembly 600 of FIG. 15*a*.

Figure 16B:
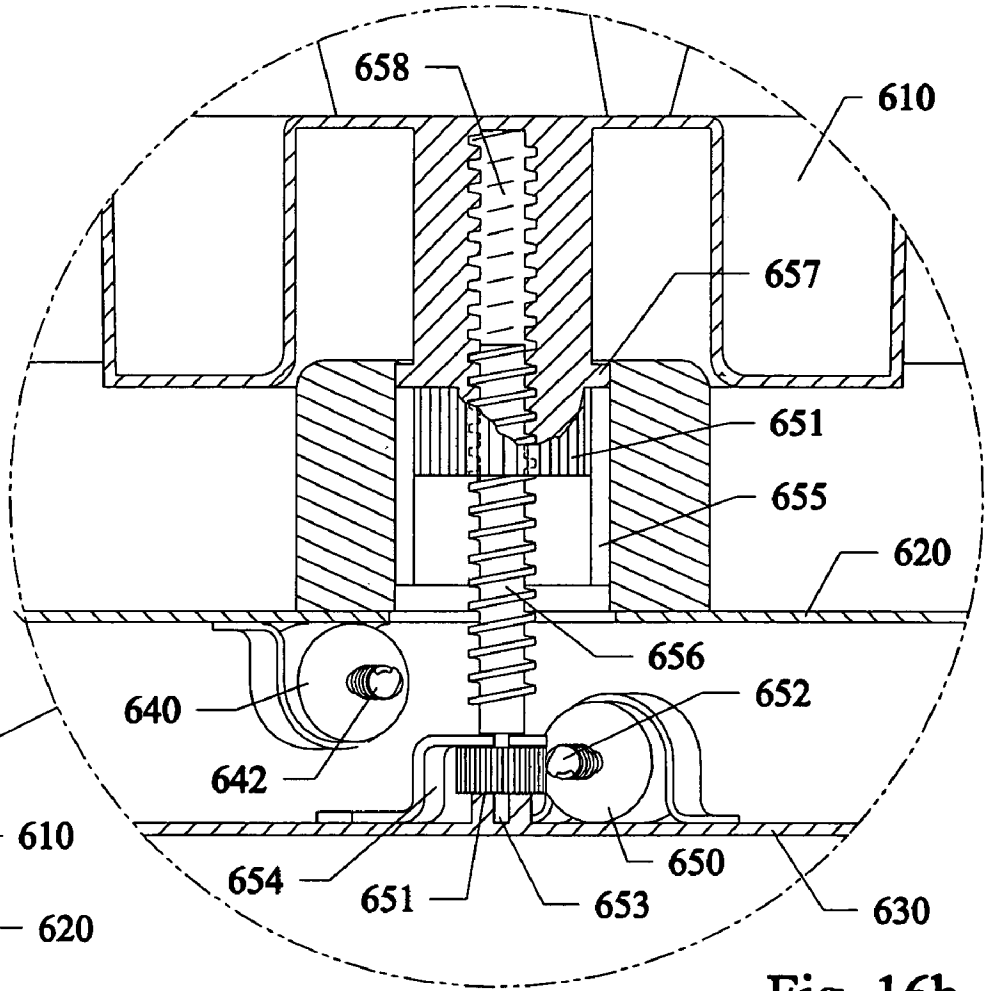
FIG. 16*b* is a detail of the ball feeder assembly from FIG. 16*a*.
Figure 16A:
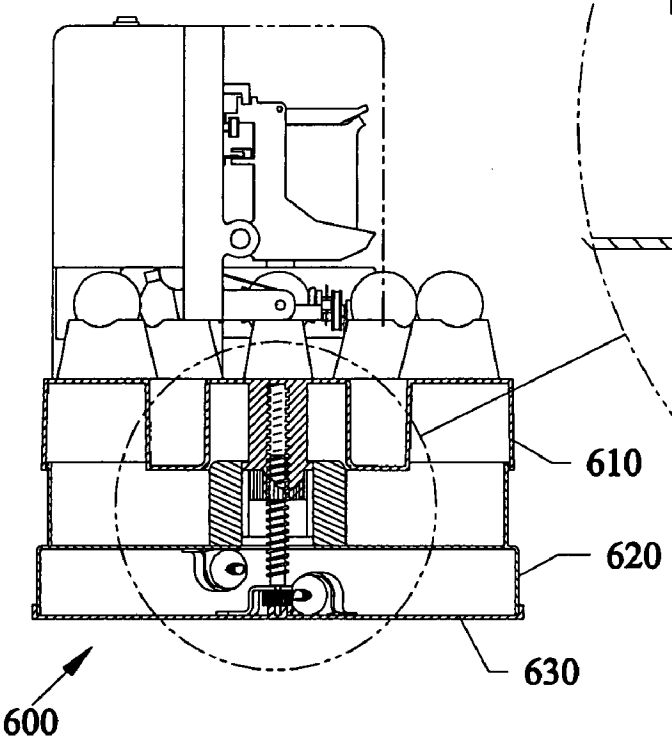
FIG. 16*a* is a section view of the subject invention, taken along line A—A of FIG. 4, with the ball feeder carousel shown in the raised position.

FIG. 16*a* is a cross sectional view of golf ball printer 100, along line A—A of FIG. 4, with ball feeder assembly 600 in the raised position. FIG. 16*b* is an enlarged section detail of the ball feeder assembly 600 of FIG. 16*a*.

Referring to FIGS. 13*a* through 16*b*, the radial drive stepping motor 640 rotates ball feeder carousel 610 by way of the radial drive worm 642 and the radial drive gear 641. The radial drive gear 641 is attached to the ball feeder carousel 610 so that rotation of the radial drive gear 641 is directly translated to rotation of the ball feeder carousel 610. A plurality of fixed rotational positions of the ball feeder carousel 610 are defined by the Z-axis drive indexing tabs 657 engaging the Z-axis indexing spline tube 655 which when acting together assures the accurate positioning of the golf ball 200 about the z-axis directly below the gimbal assembly 500 as shown in FIG. 2 in the proper position relative to the driving ball grip as shown in FIG. 8*a*.

Figure 6:
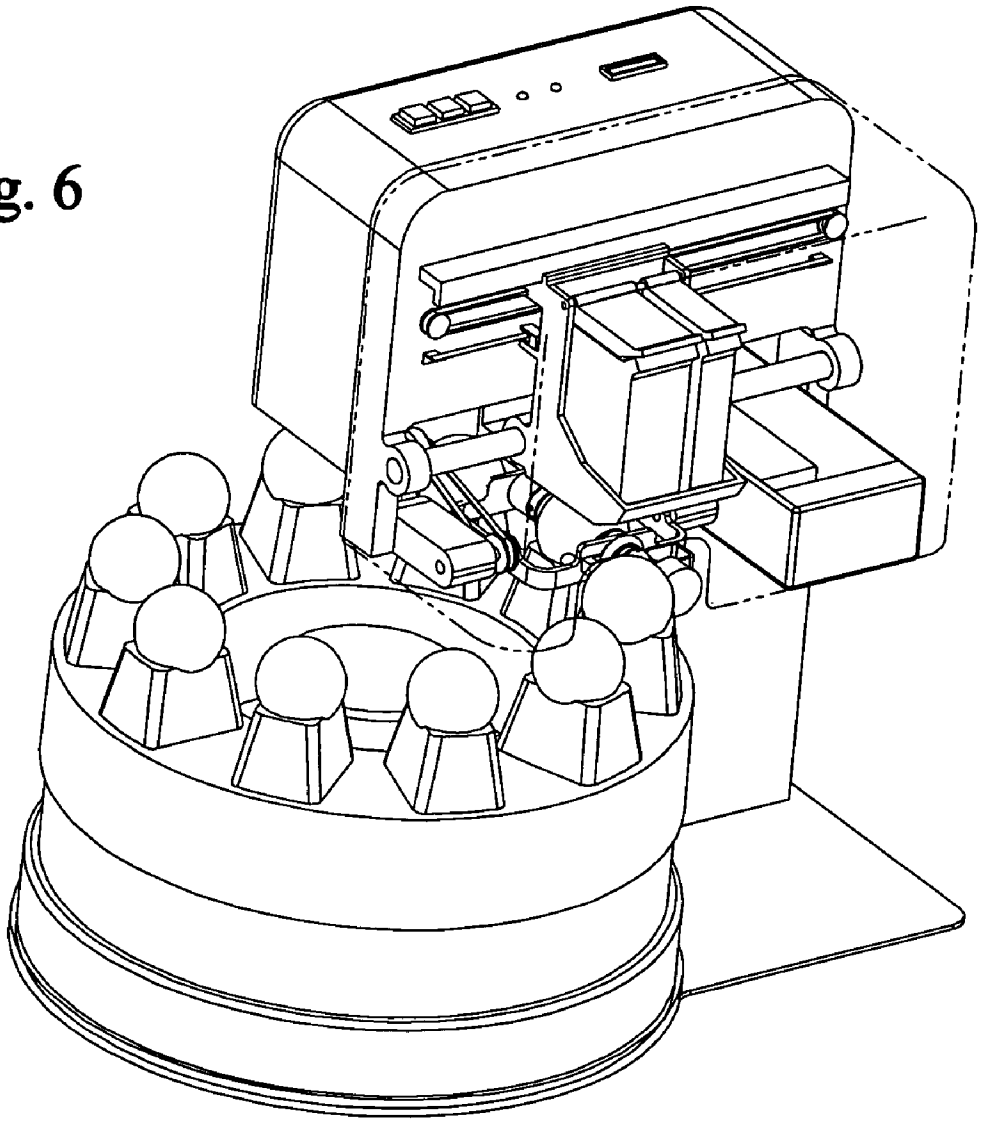
FIG. 6 is a front perspective view of the subject invention with the ball feeder carousel shown in the raised position.

Referring to FIGS. 15*b* and 16*b*, the Z-axis drive stepping motor 650 raises and lowers the ball feeder carousel 610 by way of the Z-axis drive worm 652, Z-axis drive gear 651, about axle 653, and Z-axis drive lift worm 656. As the Z-axis drive lift worm 656 is rotated, the Z-axis drive worm nut 658, attached to the ball feeder carousel 610, is driven vertically along the length of the Z-axis drive lift worm 656 and through the Z-axis indexing spline tube 655. The direction of Z-axis drive worm nut 658 travel and the resulting raising and lowering of the ball feeder carousel 610, is determined by the direction of rotation of the Z-axis drive lift worm 656. The Z-axis drive worm nut 658, with attached Z-axis indexing tabs 657 and radial drive gear 651, travel vertically through the Z-axis indexing spline tube 655 as determined by the rotation of the Z-axis drive motor 650. During the printing process the ball feeder carousel 610 is lowered enough to provide clearance for the rotation of the gimbal assembly 500 about the x-axis and y-axis. When all the golf balls have been printed the ball feeder carousel is returned to its complete lowered position FIG. 1 to unload the golf balls. If for some reason during the printing process a golf ball is not present when the ball feeder carousel is at the ball feeder up position FIG. 6 the ball out sensor 540 will recognize the condition and stop printing.

Figure 17:
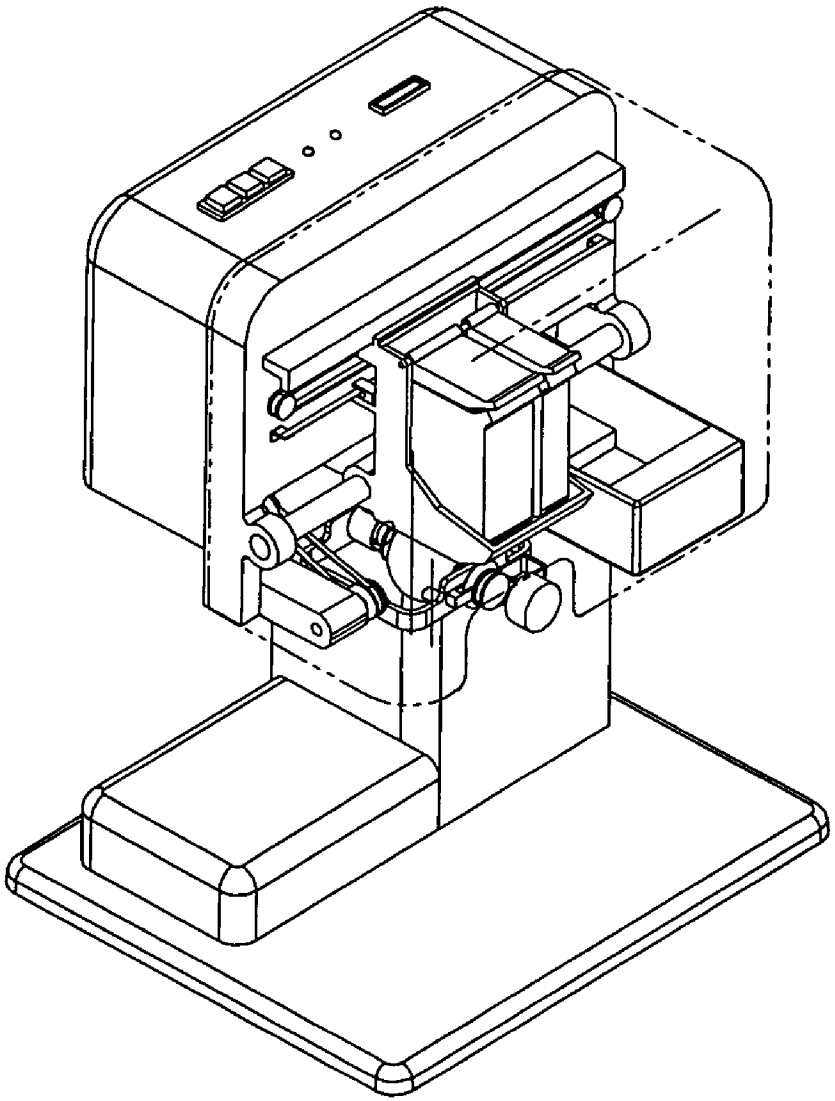
FIG. 17 is a front perspective view of the subject invention with the ball feeder assembly removed.
Figure 19:
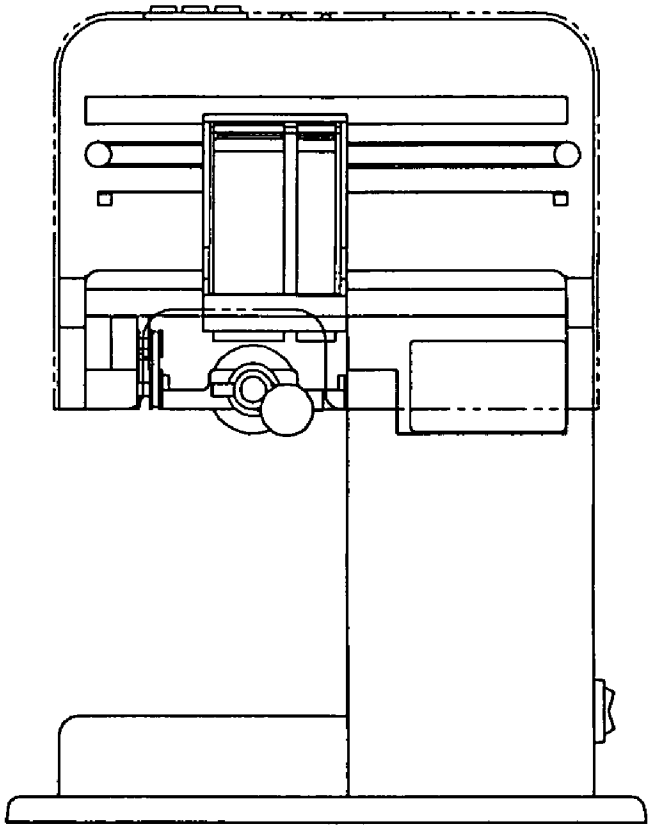
FIG. 19 is a front view of the subject invention of FIG. 17.
Figure 18:
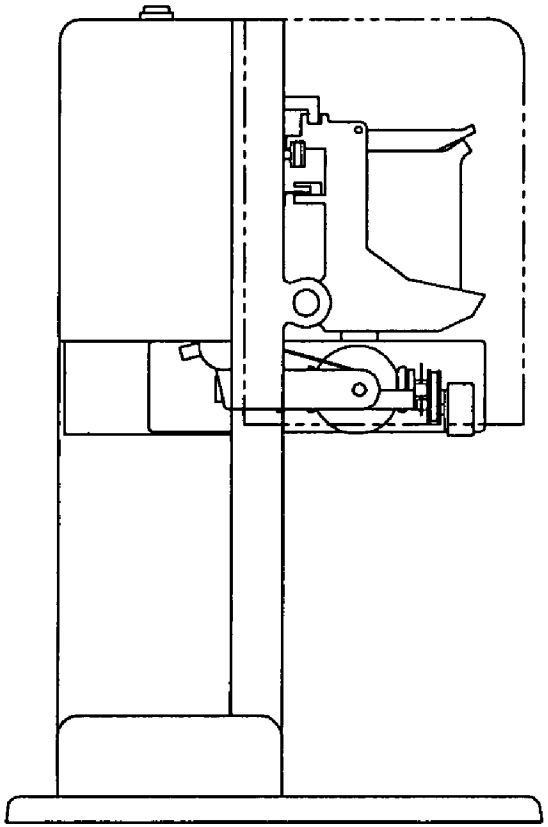
FIG. 18 is a side view of the subject invention of FIG. 17.

FIG. 17 is a perspective view of the golf ball printer 100 shown without ball feeder assembly 600. FIG. 18 is a side view of the golf ball printer 100 of FIG. 17. FIG. 19 is a front view of the golf ball printer 100 of FIG. 17. This configuration is for another embodiment of the invention for home use which is the manual ball feed configuration. Referring to FIG. 1 when the clear hinged front cover is opened the print head 400 moves to the side and provides the operator access to the gimbal assembly 500. The operator presses the control button 350. Referring to FIG. 7*a* when the control button 350 is pushed the grip solenoid 553 is activated and it retracts the sliding grip mount 555 and the attached free wheeling ball grip 551. The operator inserts the golf ball 200 against the driving ball grip 552. The operator presses button 350 and the grip solenoid 553 is de-activated and the solenoid return spring 554 pushed the sliding grip mount 555 and the attached free wheeling ball grip 551 against the golf ball 200 securing the ball for printing.

Figure 20:
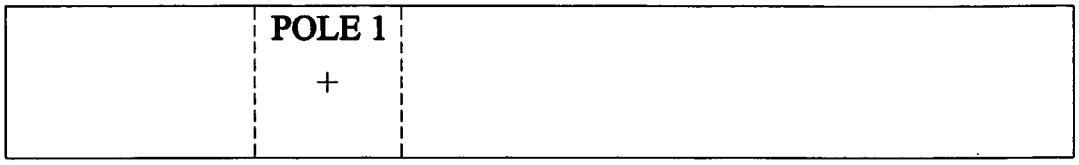
FIG. 20 shows the printing templates representing areas to be printed on the golf ball.
Figure 20:
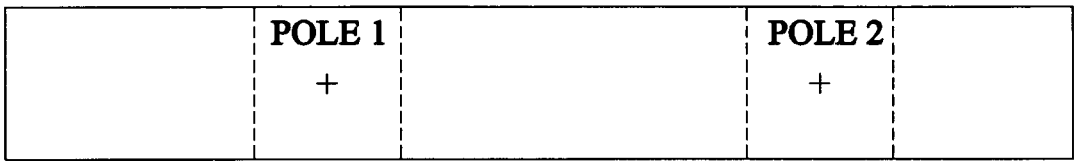
Figure 20:
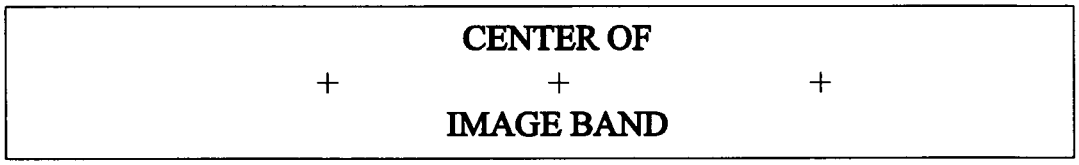

FIG. 20 illustrates the areas on the golf ball 200 that can receive printing by the subject invention. The printing can include text, text with images, or logos at a single polar location, at dual polar locations, or in a band around the circumference of ball with the band as wide as 1 inch. The Template for 1 Pole is a two dimensional representation of an area of the golf ball 200 wherein the printing is confined to 1 pole. The Template for 2 poles is a two dimensional representation of the two area of the golf ball 200 wherein the printing is confined to 2 poles. The Template for Image Band is a two dimensional representation of a band around the circumference of the golf ball 200 wherein the printing is located 360 degrees along the circumference of the golf ball 200 within a band as wide as 1 inch. The software will place the image to be printed in the selected template area or multiple areas. Within the templates the image to be printed is first automatically centered horizontally and vertically but then the option is made available for "custom placement". In the case of custom placement the user can click on each element he placed in the template and move it around to his liking and resize it if desired.

Figure 21:
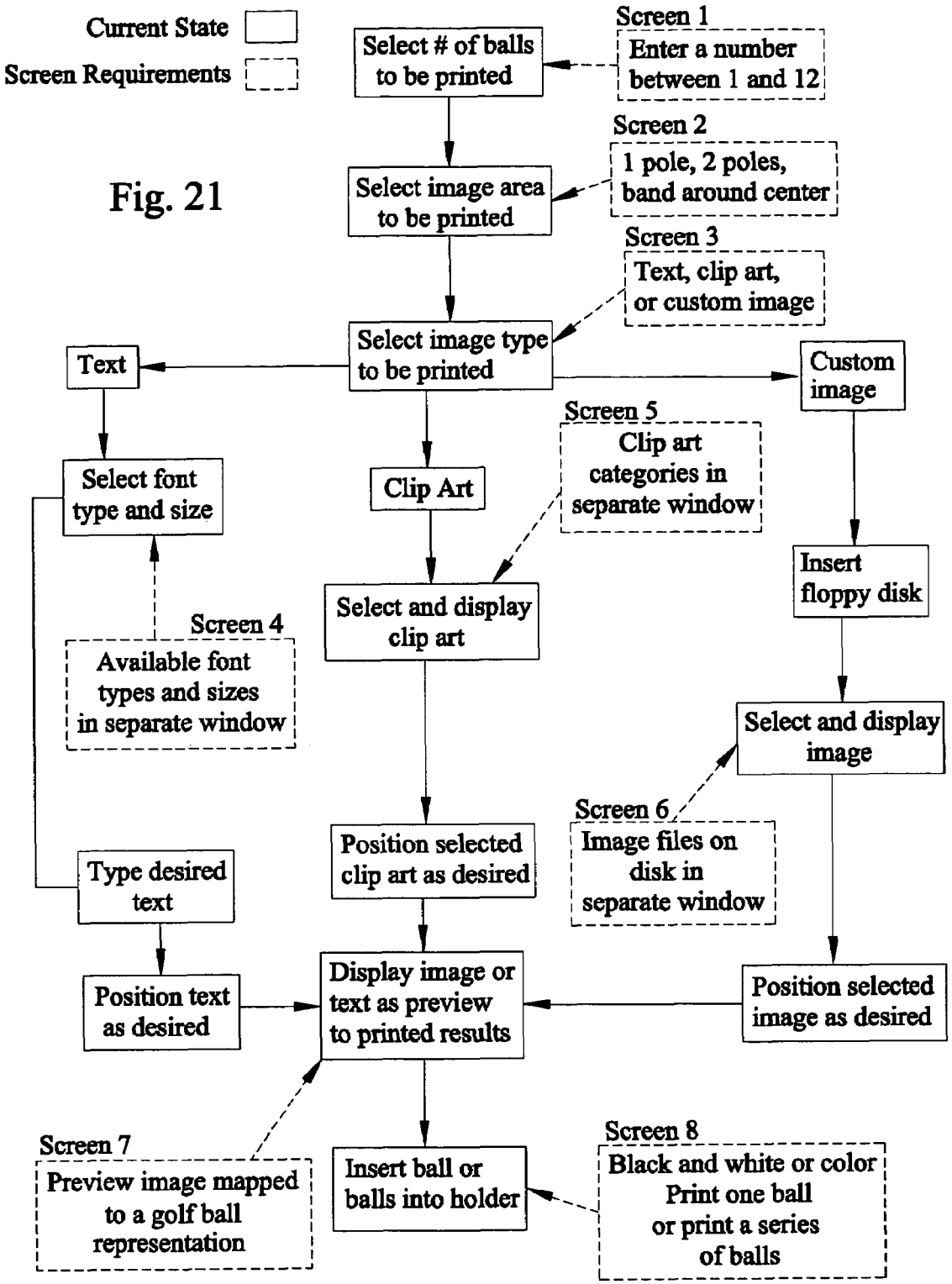
FIG. 21 is a logic diagram representing the steps involved in printing text and indicia on the golf ball.

FIG. 21 is a logic diagram representing the steps involved in printing text and indicia on the golf ball 200. Steps in the printing process are described in the blocks drawn with solid lines. Computer screens displayed to the user are described in the blocks drawn in dashed lines. "

Figure 22:
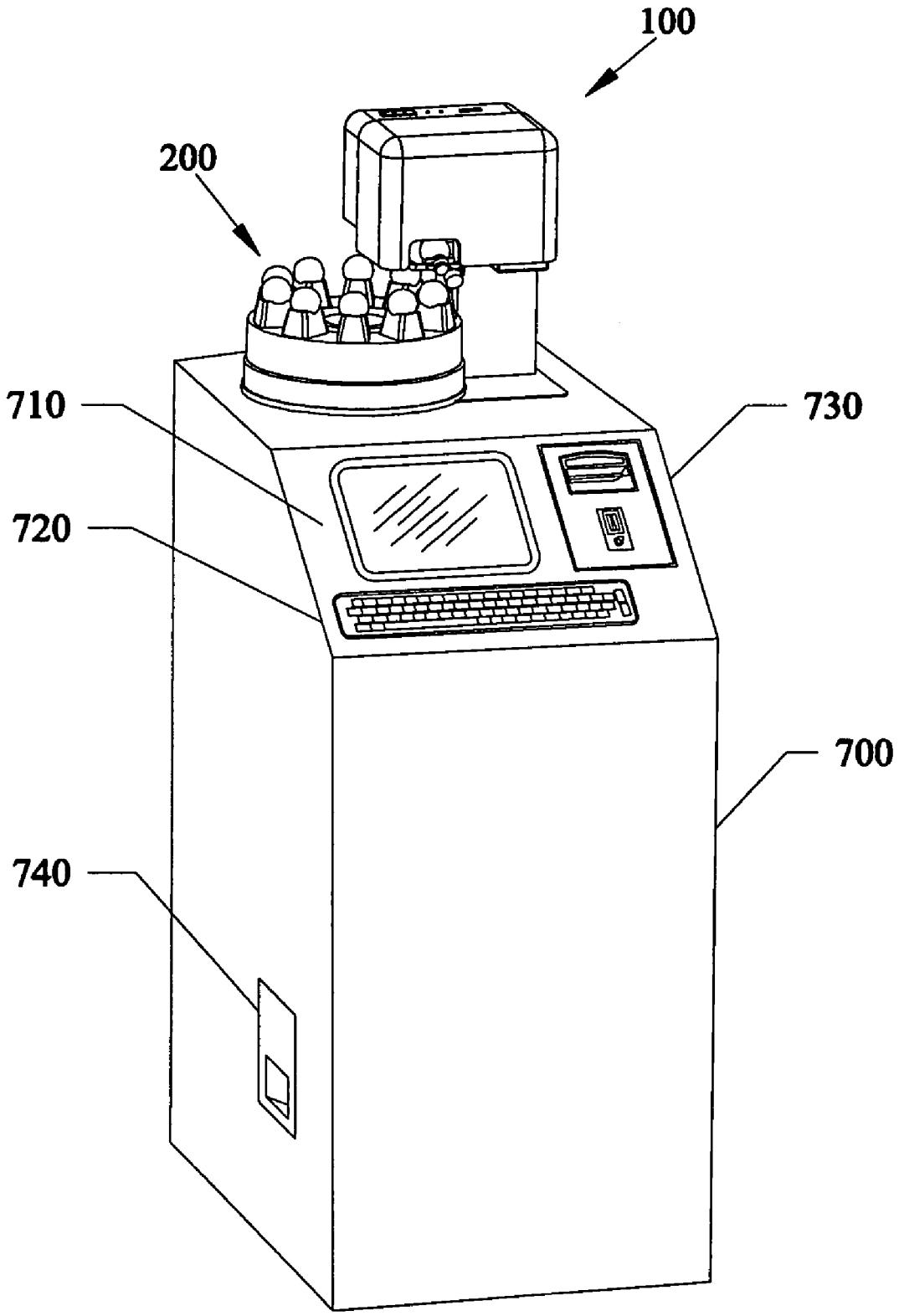
FIG. 22 is a view of the subject invention as utilized in a kiosk version.

FIG. 22 is an illustration of a second embodiment of the subject invention. The golf ball printer 100, including ball feeder assembly 600, is mounted to the kiosk base assembly 700. Kiosk base assembly 700 incorporates a computer and disk drive (not shown).

The facility is used to print text, clip art images, and/or custom images on the textured surface of golf balls. The number of golf balls and text is input by the customer through keyboard 720 and viewed on monitor screen 710. A plurality of clip art is resident on the computer for customer review and selection. Custom images, developed by the customer on his home computer with any one of a number of standard graphic programs such as Paint Shop Pro, are input via a floppy disc (not shown). The text and indicia is previewed on monitor screen 710 before printing is started.

The facility can be installed in a commercial establishment, such as a pro shop or golf course, where it will accept currency and can be operated by any individual with limited experience with computers. Payment is made by way of the bill acceptor 730 with change returned through the bill change chute 740. The bill acceptor 730 can be a standard commercial bill acceptor such as MEI Bill Acceptor Series LE 3800.

Figure 23:
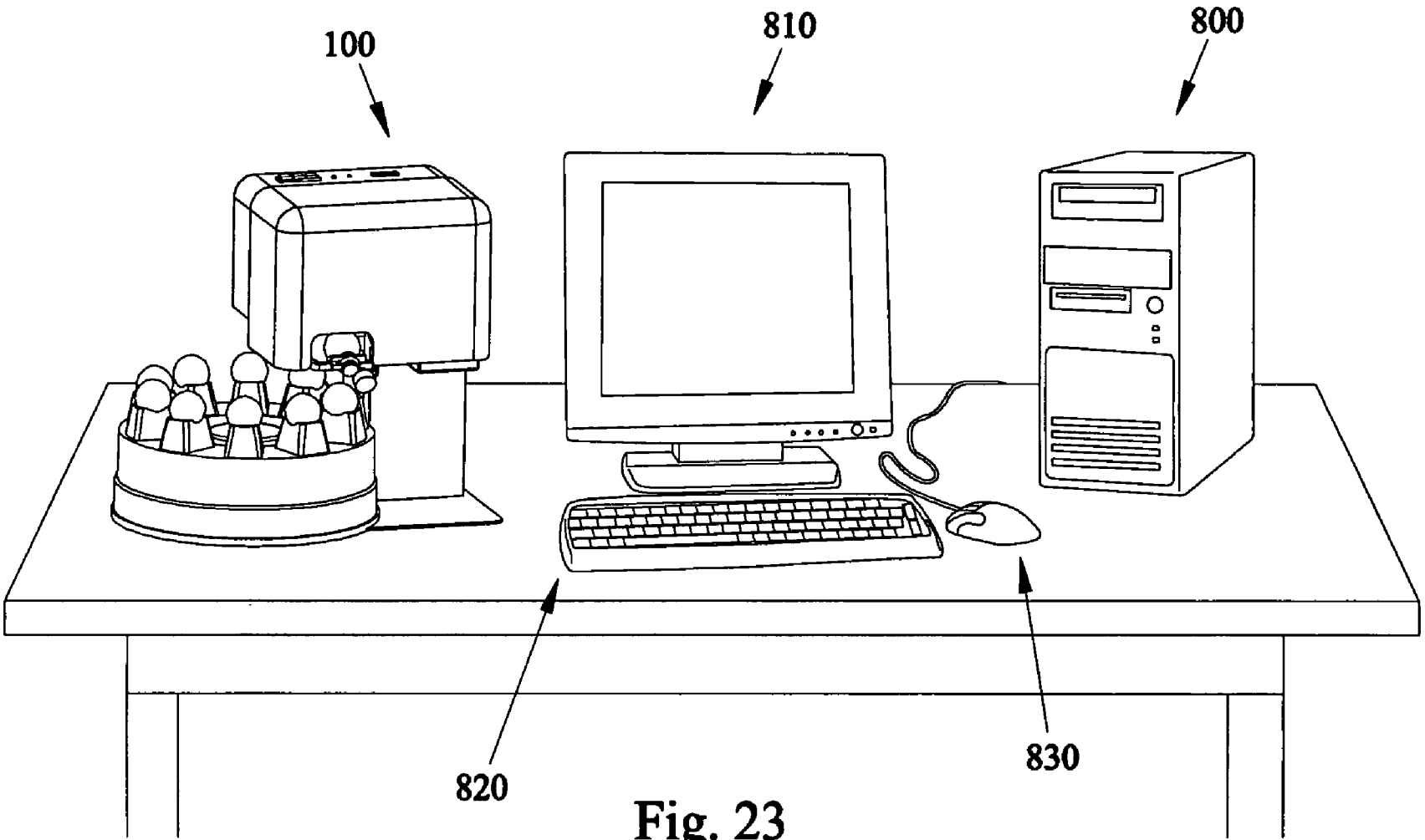
FIG. 23 is a view of the subject invention as utilized in a commercial version. This same configuration can be used in the home version by substituting the printer shown in FIG. 17 without the ball feeder assembly.

FIG. 23 is an illustration of a third embodiment of the subject invention. The golf ball printer 100, including ball feeder assembly 600, is linked to a personal computer 800.

Printing parameters are entered by way of the keyboard 820 and the mouse 830 and viewed on the computer monitor 810.

The personal computer 800 includes a computer such as an IBM compatible PC with an Intel Pentium processor and the like having a 333 MHZ or higher processor speed, including a 128 Megabytes of system RAM, 300 Megabytes of free space on a hard disk drive, and an 8 Megabyte video card. The computer monitor 810 is a standard color monitor such as a Gateway EV500 capable of 1024×768 resolution. Software for the personal computer 800 includes custom software and image manipulation software such as Paint Shop Pro to generate text, images, or logos.

Custom software allows the operator to select one of several templates that correspond to the desired location of printing on the ball and the configuration of indicia to be printed. The software allows the operator to type in information, select font size and style and/or drag and drop an image into the template. The operator can then size the image to suit personal preference.

FIGS. 17 through 19 illustrate a fourth embodiment of the subject invention. The golf ball printer 100 is configured in a less expensive configuration without the ball feeder assembly 600 for use in a home version. The golf ball printer 100 is connected to the home owner's personal computer that is running the custom software provided with the golf ball printer 100. In the home version configuration, the golf ball printer 100 would allow printing of one ball at a time.

A method of operation for the golf ball printer 100 will now be described with reference to FIG. 1. The golf ball 200 to be printed is placed and aligned to the reference marks, for proper orientation, in one of the 12 saddles of the ball feeder carousel 610. Aligning the golf ball 200 to reference marks when combined with the custom software allows printing on the object to avoid preprinted areas on the object such as the name of the ball or preexisting logos. The ball feeder assembly 600 rotates the golf ball 200 radially about the Z-axis into position below the gimbal assembly 500 using the Z-axis drive indexing tabs 657 and the Z-axis indexing spline tube 655 to provide accurate positioning of the ball feeder carousel 610. Ball feeder assembly 600 raises the golf ball 200, placed on ball feeder carousel 610, along the Z-axis into position within the gimbal assembly 500. Grip solenoid 553 clamps the golf ball 200 in the gimbal assembly 500 for printing. Once the golf ball 200 is clamped in position and ball feeder carousel 610 is lowered out of the way, the printing process starts.

The printing process is accomplished at a single station by a combination of a single black and a single multi-color inkjet cartridge with quick drying permanent ink in the print head. The print head is fixed in one position for printing while the golf ball 200 is rotated about the X-axis and Y-axis beneath the print head. Fixing the print head in a single position avoids problems with spherical transformation and print registration of the prior art that requires both object and print head to move in order to apply indicia to the surface of the object or requires the object to be moved to two or more different stations in order to apply two or more different colors of ink. Once the golf ball 200 has been printed the ink has dried immediately, the ball feeder carousel 610 is raised into position below the golf ball 200. The gimbal assembly 500 releases the golf ball 200 into the ball feeder carousel 610. The ball feeder carousel 610 is lowered with the golf ball 200 in one saddle of the ball feeder carousel 610. The ball feeder assembly 600 rotates the golf ball 200 radially about the Z-axis to present the next ball for printing.

As described above, the golf ball printer 100 can be used to print text and indicia on various types of objects, including, but not limited to, spherical objects, semi-spherical objects, objects having curved surfaces, objects having non-linear surfaces, objects having textured or irregular surfaces, or objects having non-planar surfaces. Some examples of such objects include ornaments, golf balls, eggs, tennis balls, and baseballs, other types of sports type balls, and bottles, cylinders or tubes such as prescription bottles. Furthermore, the invention advantageously allows text and indicia to be applied to one object or upwards to 12 objects and to objects with difficult or textured surfaces.

The invention can be used to print various types of indicia such as but not limited to text, text with logos, logos, designs, photographs, photocopies, combinations thereof, custom indicia, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A compact and tabletop system using permanent ink from an indicia generating source for printing graphics on an object with a non planar, textured and irregular surface at a single station up to approximately 360 degrees around the object, comprising:

a gimbal fixture for receiving, holding and rotating said object having the non-planar, tectured and irregular surface about a first axis and a second axis;

a control unit for controlling the object to be printed and movement of said object relative to the indicia-generating source so that the object is maintained at a fixed position relative to the output of the indicia-generating unit, whereby indicia is applied along the non-planar, irregular and textured surface of said object by positioning said object relative to the indicia-generating unit, wherein the fixture, the indicia generating unit, the control unit are located at a single station.

2. The system according to claim 1, further comprising:

a housing for supporting the system and receiving payment from at least one of cash and a credit card to pay for a printing.

3. The system according to claim 1, wherein said system is a free standing vending machine.

4. The system according to claim 1, wherein the indicia includes a source from a permanent, fast drying multi colored ink via an inkjet cartridge.

5. The system according to claim 1, wherein said fixture comprises a rotatable and elevatable turntable-carriage whereby said object is mounted and transported to the gimbal assembly.

6. The system according to claim 1, further including a personal computer.

7. The system according to claim 1, further including a bill acceptor.

8. A compact single station apparatus for receiving digital images and printing permanent multi-colored graphics on an object with a non planar, textured and irregular surface comprising:

an indicia-generating unit;

a gimbal for clamping and positioning said object under the indicia-generating unit;

a control unit for controlling said object relative to the indicia-generating unit so that said object is maintained at a fixed position relative to the output of the indicia-generating unit while rotating the object about a first axis and a second axis;

a support with a base on which said object is mounted; and a transfer means for moving the support and base on which said object is mounted in order to position said object under the indicia generating unit, wherein the indicia-generating unit, the positioning means, the control unit, the support and the transfer means are within a single station.

9. The apparatus according to claim 8, wherein said indicia generating unit is comprised of at least one multi-color inkjet cartridge with fast drying permanent ink.

10. The apparatus according to claim 8, wherein said transfer means is a rotatable and elevatable table for moving said object under said indicia-generating unit in such a manner as to avoid preprinted areas.

11. The apparatus according to claim 8, wherein said control unit receives the output of a personal computer.

12. A method of applying graphics to an object having non-planar, textured and irregular surfaces at a single station, comprising the steps of:

receiving and holding said object having a non-planar, textured and irregular surfaces at one station, the holding includes clamping said object in a gimbal mount;

receiving graphics data to be applied to the non-planar, textured and irregular surfaces of said object at the one station;

moving said object relative to an indicia-generating unit so that said object is maintained at a fixed distance to the output of said indicia-generating unit at the one station;

applying permanent graphics using an inkjet cartridge, to the non-planar surface of said object at the one station.

13. The method according to claim 12, wherein the applying of the graphics includes applying a band of graphics around the perimeter of said object.

14. The method according to claim 12, wherein the applying of the graphics comprises applying a single color of the graphics to the object.

15. The method according to claim 12, wherein step of applying of the graphics comprises applying the graphics in more than one color.

16. The method according to claim 12, wherein the step of receiving and holding said object comprises rotating and elevating said object on a turntable-carriage at the one station.

17. The method according to claim 12, wherein the step of applying of graphic comprises a means to select various indicia, position the indicia into a template and manipulate the images to meet a users preference.

18. An apparatus for printing graphics on an object with a non planar, textured and irregular surface at a single station comprising:

a support base;

an indicia-generating unit comprised of two inkjet cartridges;

a gimbaled mounting apparatus comprising:

a frame;

a clamping means for securing said object within said frame;

a rotating means for rotationally driving said object about a first axis;

a support means for supporting said frame at a pair of support points orthogonal to said first axis defining a second axis;

a pivoting means for pivotally driving said frame about said second axis;

whereby said object is rotationally and pivotally positioned below said indicia generating unit at a fixed distance from said indicia generating unit;

a control unit for controlling said object relative to the indicia-generating unit so that said object is maintained at a fixed position relative to the output of the indicia-generating unit, wherein the frame, the clamping means, the rotating means, the support means, and the pivoting means are located at a single station.

19. A compact single station apparatus for receiving digital images and printing permanent multi-colored graphics on an object with a non planar, textured and irregular surface comprising:

an indicia-generating unit;

a positioning means for clamping and positioning said object under the indicia-generating unit;

a control unit for controlling said object relative to the indicia-generating unit so that said object is maintained at a fixed position relative to the output of the indicia-generating unit while rotating the object about a first axis, a second axis and a third axis;

a support with a base on which said object is mounted; and a transfer means for moving the support and base on which said object is mounted in order to position said object under the indicia generating unit, wherein the indicia-generating unit, the positioning means, the control unit, the support and the transfer means are within a single station, said transfer means is a rotatable and elevatable table for moving said object with curved surface under said indicia-generating unit in such a manner as to avoid preprinted areas.

20. A method of applying graphics to an object having non-planar, textured and irregular surfaces at a single station, comprising the steps of:

receiving and holding said object having a non-planar, textured and irregular surface at one station;

receiving graphics data to be applied to the non-planar, textured and irregular surface of said object at the one station;

moving said object relative to an indicia-generating unit so that said object is maintained at a fixed distance to the output of said indicia-generating unit at the one station, the moving comprises rotating and pivoting said object in a gimbal mount;

applying permanent graphics using an inkjet cartridge, to the non-planar surface of said object at the one station.

21. A method of applying graphics to an object having non-planar, textured and irregular surfaces at a single station, comprising the steps of:

receiving and holding said object having a non-planar, textured and irregular surface at one station, the step of receiving and holding said object comprises rotating and elevating said object on a turntable-carriage at the one station;

receiving graphics data to be applied to the non-planar, textured and irregular surface of said object at the one station;

moving said object relative to an indicia-generating unit so that said object is maintained at a fixed distance to the output of said indicia-generating unit at the one station;

applying permanent graphics using an inkjet cartridge, to the non-planar surface of said object at the one station.

* * * * *